US010815947B2

(12) United States Patent
Kylström

(10) Patent No.: US 10,815,947 B2
(45) Date of Patent: Oct. 27, 2020

(54) HIGH PRESSURE FUEL PUMP FOR A FUEL SYSTEM

(71) Applicant: Scania CV AB, Södertälje (SE)

(72) Inventor: Kim Kylström, Tullinge (SE)

(73) Assignee: Scania CV AB, Södertälje (SE)

( * ) Notice: Subject to any disclaimer, the term of this patent is extended or adjusted under 35 U.S.C. 154(b) by 261 days.

(21) Appl. No.: 15/500,810

(22) PCT Filed: Aug. 27, 2015

(86) PCT No.: PCT/SE2015/050905

§ 371 (c)(1),
(2) Date: Jan. 31, 2017

(87) PCT Pub. No.: WO2016/043642

PCT Pub. Date: Mar. 24, 2016

(65) Prior Publication Data

US 2017/0226977 A1 Aug. 10, 2017

(30) Foreign Application Priority Data

Sep. 15, 2014 (SE) ..... 1451061-4

(51) Int. Cl.
*F02M 59/36* (2006.01)
*F02M 63/02* (2006.01)
(Continued)

(52) U.S. Cl.
CPC ..... *F02M 59/367* (2013.01); *F02M 59/368* (2013.01); *F02M 59/46* (2013.01);
(Continued)

(58) Field of Classification Search
CPC .... F02M 59/367; F02M 59/368; F02M 59/46; F02M 63/02; F04B 17/04; F04B 53/14
See application file for complete search history.

(56) References Cited

U.S. PATENT DOCUMENTS

2009/0271096 A1 10/2009 Matsubara
2011/0097228 A1 4/2011 Tokuo et al.
(Continued)

FOREIGN PATENT DOCUMENTS

DE 102012207744 A1 11/2013

OTHER PUBLICATIONS

International Search Report for PCT/SE2015/050905 dated Dec. 21, 2015.

(Continued)

*Primary Examiner* — Lindsay M Low
*Assistant Examiner* — Ruben Picon-Feliciano
(74) *Attorney, Agent, or Firm* — Moore & Van Allen PLLC; W. Kevin Ransom

(57) ABSTRACT

The present invention relates to a high pressure fuel pump comprising an inlet channel in connection with a first chamber, through which inlet channel fuel is led to the first chamber, a second chamber arranged in connection with the first chamber, an outlet valve arranged in connection with the second chamber and an inlet valve comprising a piston, with a first end section and a second end section. The piston is moveably arranged with the first end section in a third chamber, and the second end section is moveably arranged between the first chamber and the second chamber. A press element is arranged to act on the piston with a mechanic force, so that the piston strives to be positioned with the second end section closing the connection between the first chamber and the second chamber. The inlet valve is in a closed state and may be controlled via an electromagnetic unit.

12 Claims, 5 Drawing Sheets

(51) Int. Cl.
*F04B 17/04* (2006.01)
*F04B 53/14* (2006.01)
*F02M 59/46* (2006.01)

(52) U.S. Cl.
CPC ..... *F02M 63/02* (2013.01); *F04B 17/04* (2013.01); *F04B 53/14* (2013.01)

(56) References Cited

U.S. PATENT DOCUMENTS

| | | | | |
|---|---|---|---|---|
| 2012/0095669 | A1 | 4/2012 | Katsurahara | |
| 2014/0134027 | A1* | 5/2014 | Schanz | F04B 1/0452 417/559 |
| 2017/0248110 | A1* | 8/2017 | Hashida | F02M 59/368 |

OTHER PUBLICATIONS

Written Opinion of the International Searching Authority for PCT/SE2015/050905 dated Dec. 17, 2015.
Swedish Office Action for Swedish Patent Application No. 1451061-4 dated May 4, 2015.
International Preliminary Report on Patentability for International Patent Application No. PCT/SE2015/050905 dated Mar. 21, 2017.

* cited by examiner

HIGH PRESSURE FUEL PUMP FOR A FUEL SYSTEM

CROSS-REFERENCE TO RELATED APPLICATION(S)

This application is a national stage application (filed under 35 § U.S.C. 371) of PCT/SE15/050905, filed Aug. 27, 2015 of the same title, which, in turn claims priority to Swedish Application No. 1451061-4, filed Sep. 15, 2014 of the same title; the contents of each of which are hereby incorporated by reference

FIELD OF INVENTION

The present invention relates to a high pressure fuel pump for a fuel system, a fuel system with such a high pressure fuel pump, a combustion engine with such a high pressure fuel pump, a vehicle with such a high pressure fuel pump and a method for a high pressure fuel pump in a combustion engine.

BACKGROUND OF THE INVENTION

Combustion engines, such as diesel engines or Otto engines, are used in several types of applications and vehicles today, for example in heavy goods vehicles, such as trucks or buses, passenger cars, motor boats, vessels, ferries and ships. Combustion engines are also used in industrial engines and/or engine driven industrial robots, power plants such as e.g. electric power plants comprising a diesel generator, and in locomotives.

Combustion engines may be operated with diesel or petrol. Such engines are is equipped with a fuel system to transport fuel from one or several fuel tanks to the combustion engine's injection system. The fuel system comprises one or several fuel pumps, which may be driven mechanically by the combustion engine or may be driven by an electric motor. The fuel pumps create a fuel flow and pressure to transport the fuel to the combustion engine's injection system, which supplies the fuel to the combustion engine's combustion chamber.

Fuel systems may comprise one or several low pressure fuel pumps, which operate in a low pressure circuit in the fuel system and supply fuel to a high pressure fuel pump. The high pressure fuel pump is arranged in a high pressure circuit in the fuel system, and feeds the fuel along to the combustion engine's injection system. In order to control the fuel flow into the high pressure fuel pump, and thus the fuel flow to the combustion engine, there is normally an inlet valve arranged in connection with the high pressure fuel pump. With an actively controllable inlet valve, the fuel flow which is supplied further to the combustion engine may be regulated in a controlled and accurate manner. Should the active inlet valve fail to function, for example due to an electric fault, however, no fuel is supplied to the high pressure fuel pump and the high pressure fuel pump cannot pump fuel further to the combustion engine, and as a result the combustion engine is turned off. A fuel system with an active inlet valve is thus sensitive to disruptions and may cause unwanted operational disruptions.

Document DE102012207744 shows a fuel system with an actively controllable valve arranged in connection with the high pressure fuel pump. When the valve does not function, an alternative fuel supply is achieved, by way of pulsing a low pressure feeding pump's feeding pressure. This solution requires that the valve is normally in an open state.

Despite prior art solutions in the area, there remains a need to further develop a high pressure fuel pump, which ensures, in a reliable manner, that fuel may be supplied to the combustion engine even if a controllable valve stops functioning.

SUMMARY OF THE INVENTION

The objective of the present invention is to achieve, in a fuel system for a combustion engine, a high pressure fuel pump facilitating both passive and active control of the fuel flow to the combustion engine. Passive control means control not requiring power supply, and active control means control requiring power supply.

The objective of the invention is also to achieve, in a fuel system for a combustion engine, a high pressure fuel pump entailing a redundancy in case of loss of active control.

Another objective of the invention is to achieve, in a fuel system for a combustion engine, a high pressure fuel pump minimizing the risk of operational disruptions.

Another objective of the present invention is to achieve a method for a high pressure fuel pump in a fuel system for a combustion engine, which method minimizes the risk of operational disruptions.

According to the invention, the objectives set out above are achieved with a high pressure fuel pump for a fuel system, suitably in a combustion engine, the pump comprising an inlet channel in connection with a first chamber, and through which fuel is led to the first chamber with a feeding pressure P, a second chamber arranged in connection with the first chamber, an outlet valve arranged in connection with the second chamber and an inlet valve, comprising a piston with a first end section and a second end section, wherein the piston is moveably arranged with the first end section in a third chamber, and the second end section is moveably arranged between the first chamber and the second chamber. Furthermore, a press element is arranged to act on the piston with a mechanic force, so that the piston strives to be positioned with the second end section closing the connection between the first chamber and the second chamber, and so that the inlet valve is thus in a closed state, wherein the inlet valve is controllable, due to an electromagnetic unit being arranged in the third chamber, in order to act with a magnetic force on the first end section of the piston, so that the piston moves. The term mechanic force, as used herein, means the force provided by the press element.

The invention also relates to a combustion engine and a vehicle comprising the high pressure fuel pump described above.

According to another aspect, the invention relates to a method for a high pressure fuel pump in a fuel system for a combustion engine, the pump comprising an inlet channel in connection with a first chamber, and through which fuel is led to the first chamber with a feeding pressure P, a second chamber arranged in connection with the first chamber, and an outlet valve arranged in connection with the second chamber, wherein the inlet valve comprises a piston with a first end section and a second end section, wherein the piston is moveably arranged with the first end section in a third chamber, and the second end section is moveably arranged between the first chamber and the second chamber. The method comprises the steps:

to provide a press element arranged to act on the piston with a mechanic force, so that the piston strives to be positioned with the second end section closing the connection between the first chamber and the second chamber, and so that the inlet valve is thus in a closed state; and to control the inlet valve with an electromagnetic unit arranged in the third chamber, which unit acts on the piston of the inlet valve with a magnetic force, so that the piston moves.

DETAILED DESCRIPTION OF THE INVENTION

The invention is described below with reference to the high pressure fuel pump and the method, which were described generally above.

A completely actively controllable inlet valve to a high pressure fuel pump is sensitive to disruptions and may cause operational outages if the active control does not function satisfactorily. With a completely passive inlet valve, on the other hand, the control of the fuel flow to the high pressure pump is less accurate and controlled than when an active inlet valve is used. By arranging a press element, such as a spring element, to act passively on the inlet valve's piston and an electromagnetic unit to act actively on the piston of the inlet valve, an inlet valve is achieved, which may be controlled both actively and passively. The press element is suitably arranged to act on the first end section of the piston, in order to achieve a maximum mechanic force. Similarly, the magnetic force that is obtained via the electromagnetic unit is arranged to act on the piston's first end section. Thus, a high pressure fuel pump is achieved, which facilitates both passive and active control of the fuel flow to the combustion engine, and which thus minimizes the risk of operational disruptions.

The term high pressure fuel pump, as used herein, means a pump with a high feeding pressure, which may vary between approximately 1000-2500 bar, but is not limited to this interval.

Suitably, fuel is supplied from the low pressure circuit in the fuel system to the inlet channel and the first chamber. The feeding pressure entails a flowing force, which acts on the piston in a direction that is opposite to the mechanic force. The feeding pressure that has to act on the piston is determined based on the pump's performance and the inlet valve's geometrical dimensions, as well as a force balance between these, and may be determined in advance.

The feeding pressure is suitably achieved with a low pressure pump operated by an electric motor and arranged in the fuel system's low pressure circuit. Since the low pressure pump is operated by an electric motor, a broader control interval is allowed than with a mechanic pump, which is usually operated and controlled by a combustion engine, and in particular by the engine speed of the combustion engine. The low pressure pump operated by an electric motor may be controlled towards parameters other than engine speed, e.g. fuel filter clogging level and pressure inside the fuel conduits.

Suitably, the magnetic force acting on the piston is achieved by way of an electric current being led through the electro-magnetic unit. Thus, a magnetic field is achieved, and with this a magnetic force dragging the piston towards the electromagnetic unit. The electromagnetic field may be achieved, for example, with the help of an actuator, such as an electromagnetic coil or a piezo-element. The piston may also comprise a magnetic material, e.g. a metal, such as stainless steel.

According to one aspect of the present invention, the electromagnetic unit is arranged to act with the magnetic force on the piston in a direction that is opposite to the mechanic force, which is preferably a spring force, in order thus to achieve an open state of the inlet valve. The mechanic force may also be achieved through pneumatic devices or hydraulic devices. Thus, the magnetic force acts on the piston in the same direction as the flow force. The mechanic force acts passively on the piston in a direction entailing a closed state of the inlet valve, so that the connection between the first chamber and the second chamber is closed and no fuel may be supplied through the outlet valve and on to the combustion engine. In order to achieve an open state of the inlet valve the sum of the magnetic force and the flow force must therefore exceed the mechanic force. The magnetic force depends on the electric current led through the electromagnetic unit. By controlling the supply of the electric current, the inlet valve may thus actively be controlled to an open state, and the fuel supply to the combustion engine may thus be achieved in an accurate and flexible manner. In order to achieve the closed state, the supply of the electric current is controlled in such a manner that the magnetic force becomes zero, so that the mechanic force moves the piston to the closed state. In cases where the electromagnetic unit does not function and the magnetic force is thus substantially zero, an open state of the inlet valve may be achieved by way of ensuring that the flow force exceeds the mechanic force. The flow force is suitably increased by controlling the low pressure pump in such a way that the feeding pressure exceeds a predetermined feeding pressure, which is determined based on the performance of the pump and the piston's geometrical dimensions and may, for example, be approximately 6 bar. By increasing the feeding pressure of the fuel from the low pressure circuit and thus increasing the flow force, an open state of the inlet valve may be achieved also when the electromagnetic unit fails, and redundancy is thereby obtained. This ensures that fuel may be fed to the combustion engine when needed, and the risk of operational disruptions is minimized.

According to one aspect of the present invention, the electromagnetic unit is arranged to act with the magnetic force on the piston in the same direction as the mechanic force, to achieve a closed state of the inlet valve. The magnetic force thus acts on the piston in the opposite direction of the flow force. In order to achieve an open state of the inlet valve, the flow force must therefore exceed the magnetic force and the mechanic force. When the combustion engine needs fuel, it is ensured that no electric current is led through the electromagnetic unit, so that the magnetic force acting on the piston is negligible. The flow force thus only has to exceed the mechanic force, in order to achieve an open state of the inlet valve. By arranging a press element that acts with a mechanic force, which is lower than the flow force caused by a normal feeding pressure, an open state of the inlet valve is achieved passively when the magnetic force is negligible. The mechanic force, e.g. the spring force, with which a spring element acts on the piston, is determined in advance based on the performance of the pump and the dimensions of the piston. In cases where the electromagnetic unit does not function and the magnetic force is thus substantially zero, an open state of the inlet valve may thus be achieved, since the flow force exceeds the mechanic force, such as the spring force. This ensures that fuel may be fed to the combustion engine when needed, and the risk of operational disruptions is minimized.

According to one aspect of the present invention, the electromagnetic unit is arranged to act with the magnetic force on the piston in the same direction as the mechanic force, preferably the spring force according to the above, wherein a passage is arranged between the inlet channel and the third chamber. Fuel fed through the inlet channel may thus flow to the third chamber. The fuel is fed from the low pressure circuit. Thus, fuel acts both on the first end section and the second end section of the piston. Thus, the fuel acts on a larger total area of the piston, and thus a greater flow force is achieved than without the passage.

The outlet valve is preferably a check valve.

Suitably, a press element is moveably arranged in the second chamber in connection with a camshaft of the combustion engine. The pressure element is arranged to increase the pressure of the fuel in the second chamber, and thus to feed the fuel through the outlet valve. When the camshaft rotates, the pressure element in the second chamber moves. When the pressure element moves in a direction towards the first chamber and the inlet valve is in a closed state, the second chamber's volume decreases, and the pressure of the fuel in the second chamber increases. The outlet valve is thus set into an open state, and the fuel in the second chamber may be fed further toward the combustion engine. When the pressure element moves in a direction opposite to the first chamber, the inlet valve is moved to an open state, so that fuel may flow from the first chamber to the second chamber.

Preferably, the press element is a spring element and the mechanic force is a spring force. Thus, a robust and non-bulky solution is achieved.

The invention also relates to a fuel system for a combustion engine, which system comprises the high pressure fuel pump described above. A fuel system provides fuel from one or several fuel tanks to the combustion engine and comprises a low pressure circuit that feeds fuel with a low pressure to the high pressure circuit. The high pressure circuit then feeds fuel along to the combustion engine with the help of one or several injection devices. Fuel systems of this type and parts thereof are prior art and are not described in further detail herein.

By providing a press element arranged to act on the piston, preferably on the first end section, with a mechanic force, preferably a spring force, so that the piston strives to be positioned with the second end section closing the connection between the first chamber and the second chamber, and so that the inlet valve is thus in a closed state; and by controlling the inlet valve with an electromagnetic unit arranged in the third chamber, which unit acts with a magnetic force on the inlet valve's piston, so that the piston moves, a method is achieved to control a high pressure fuel pump, which method minimizes the risk of operational disruptions. The method is suitably carried out in a fuel system of a combustion engine.

According to one aspect of the present invention, the inlet valve is controlled by controlling the supply of electric current through the electromagnetic unit.

According to one aspect of the present invention, the electromagnetic unit is arranged in such a manner that the magnetic force acts on the piston in a direction opposed to the mechanic force.

According to one aspect of the present invention, the electromagnetic unit is arranged in such a manner that the magnetic force acts on the piston in the same direction as the mechanic force.

According to one aspect of the present invention, an open state is achieved in the inlet valve, in the event the electromagnetic unit is out of order, by ensuring that the flow force is greater than the mechanic force. In cases where the magnetic force is intended to act on the piston in a direction opposed to the mechanic force, and the electromagnetic unit is out of order, an open state of the inlet valve is achieved by increasing the feeding pressure of the fuel from the low pressure circuit, and thus increasing the flow force acting on the piston. This ensures that the flow force is greater than the mechanic force. In cases where the magnetic force is intended to act on the piston in the same direction as the mechanic force, and the electromagnetic unit is out of order, an open state of the inlet valve is achieved by ensuring that the press element, such as a spring element, has a mechanic force, such as a spring force, which is smaller than a flow force caused by a normal feeding pressure.

Other advantages of the invention are set out in the detailed description of the invention's example embodiments below.

BRIEF DESCRIPTION OF THE DRAWINGS

Below is a description, as an example, of preferred embodiments of the invention with reference to the enclosed drawings, in which.

DETAILED DESCRIPTION OF THE INVENTION

Figure 1:
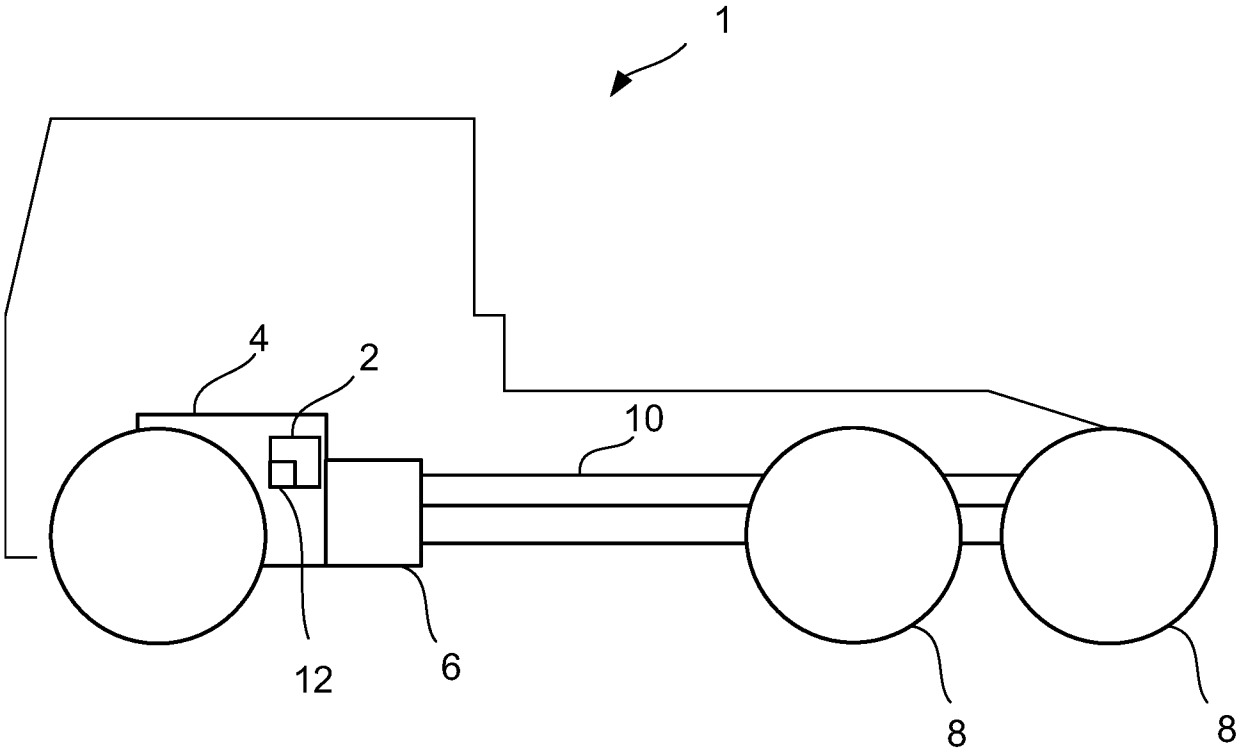
FIG. 1 shows a schematic side view of a vehicle, which comprises a fuel system for a combustion engine according to the present invention.

FIG. 1 shows a schematic side view of a vehicle 1, which vehicle comprises a fuel system 4 for a combustion engine 2. In the combustion engine 2 a high pressure fuel pump 12 is arranged according to the present invention. The combustion engine 2 is connected to a gearbox 6, which is further connected to the driving wheels 8 of the vehicle 1 via a transmission. The vehicle also comprises a chassis 10.

Figure 2:
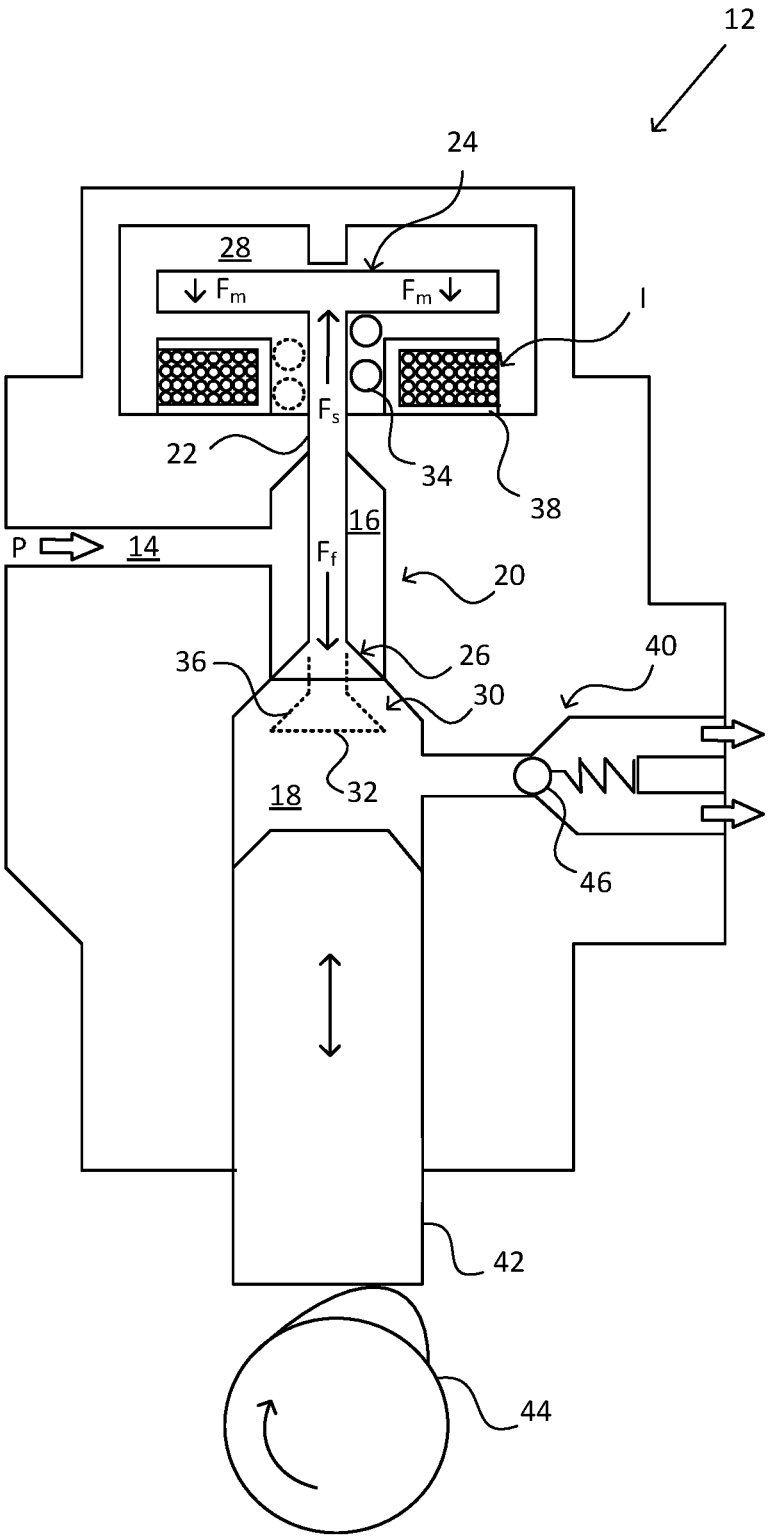
FIG. 2 shows a schematic cross sectional view of a high pressure fuel pump according to one aspect of the present invention.

FIG. 2 shows a schematic cross sectional view of a high pressure fuel pump 12 according to one aspect of the present invention. The high pressure fuel pump 12 comprises an inlet channel 14 in connection with a first chamber 16, and through which fuel (symbolized with enlarged arrows) from a low pressure circuit 110 (see FIG. 5) in a fuel system 4 is led to the first chamber 16, a second chamber 18 arranged in connection with the first chamber 16, an inlet valve 20 arranged in connection with the second chamber 18, in order to achieve that fuel flows from the first chamber 16 to the second chamber 18, and an outlet valve 40 arranged in connection with the second chamber 18, in order to feed fuel further along to the combustion engine 2. The inlet valve 20 comprises a piston 22 with a first end section 24 and a second end section 26, wherein the piston 22 is moveably arranged with the first end section 24 in a third chamber 28, and the second end section 26 is moveably arranged between the first chamber 16 and the second chamber 18. When the inlet valve 20 is in a closed state, the second end section 26 closes the connection between the first chamber 16 and the second chamber 18, and when the inlet valve 20 is in an open state (illustrated with dashed lines), fuel may flow from the first chamber 16 to the second chamber 18 through an inlet passage 30. The second end section 26 is suitably adapted like a truncated cone, with a bottom 32 having an area at least equivalent to the cross sectional area of a first chamber 16 at the connection with the second chamber 18. When the inlet valve 20 is in the closed state, the bottom 32 of the second end section 26 is thus arranged in a tightly fitting manner between the first chamber 16 and the second chamber 18. When the inlet valve 20 is in an open state, the second end section 26 of the piston 22 has been moved into the second chamber 28, so that the inlet passage 30 is formed.

A spring element 34 is arranged to act on the first end section 24 of the piston 22 with a spring force $F_s$, so that the piston 22 strives to be positioned with the second end section 26 closing the connection between the first chamber 16 and the second chamber 18, and so that the inlet valve 20 is thus in a closed state. The forces are symbolized with arrows in the drawings. The spring element 34 is arranged in the third chamber 28 and acts on the first end section 24 of the piston 22. The first end section 24 is suitably T-shaped. The spring force $F_s$ is determined based on the performance of the pump and the dimensions of the piston. Fuel is fed from the low pressure circuit 110 into the inlet channel 14 with a feeding pressure P, which entails that the fuel acts on the piston 22 with a flow force $F_f$ in a direction opposed to the spring force $F_s$. The feeding pressure P and the flow force $F_f$ are also determined based on the performance of the pump and the dimensions of the piston. The flow force $F_f$ that acts on the piston 22 depends on the feeding pressure P and the area of the angled sides 36 of the second end section 26, on which area the feeding pressure P acts. Generally, the larger the area, the greater the flow force $F_f$.

The inlet valve 20 is actively controllable since an electromagnetic unit 38 is arranged in the third chamber 28, in order to act with a magnetic force $F_m$ on the first end section 24 of the piston 22, so that the piston 22 moves. The electromagnetic unit 38 is arranged in such a manner that the magnetic force $F_m$ acts on the first end section 24 of the piston 22 in a direction opposed to the spring force $F_s$. The magnetic force $F_m$ is achieved by way of an electric current I being led through the electromagnetic unit 38. In order to achieve an open state of the inlet valve 20, the sum of the magnetic force $F_m$ and the flow force $F_f$ must exceed the spring force $F_s$. The spring force $F_s$, the flow force $F_f$ and the magnetic force $F_m$ are illustrated as arrows in the direction, in which the respective force acts on the piston 22. By controlling the supply of electric current I through the electromagnetic unit 38, the magnetic force $F_m$ may be controlled, and the inlet valve 20 may thus be actively controlled to an open state, so that fuel may be supplied to the second chamber 18. In order to achieve a closed state of the inlet valve 20, the supply of electric current I through the electromagnetic unit 38 is stopped, and the magnetic force $F_m$ is accordingly zero. The spring force $F_s$ is greater than the flow force $F_f$, and the piston 22 thus moves to a closed state. Should the electromagnetic unit 38 fail to function, the magnetic force $F_m$ becomes zero, and to achieve an open state of the inlet valve 20, the flow force $F_f$ must in this case exceed the spring force $F_s$. This may be achieved by increasing the feeding pressure P of the fuel from the low pressure circuit, and thus increasing the flow force $F_f$ that acts on the piston 22. This ensures that redundancy is obtained and that the combustion engine 2 is supplied with fuel, even in cases where the active control of the inlet valve 20 does not function.

The high pressure fuel pump 12 also comprises a pressure element 42, which is moveably arranged in the second chamber 18. The pressure element 42 is arranged in connection with a camshaft 44 in the combustion engine 2, and when the camshaft 44 rotates the pressure element 42 in the second chamber 18 moves in a direction towards and away from the first chamber 16. When the pressure element 42 moves in a direction towards the first chamber 16, the inlet valve 20 is controlled to a closed state, the volume of the second chamber 18 decreases and the pressure of the fuel in the second chamber 18 increases. The increased pressure of the fuel in the second chamber 18 acts on the outlet valve 40, so that it opens and fuel may be fed further along to the combustion engine 2. The outlet valve 40 suitably consists of a check valve comprising a spring loaded ball 46. When the pressure element 42 moves in a direction away from the first chamber 16, the volume of the second chamber 18 increases and the inlet valve 20 is controlled to an open state, so that fuel may flow from the first chamber 16 to the second chamber 18.

Figure 3:
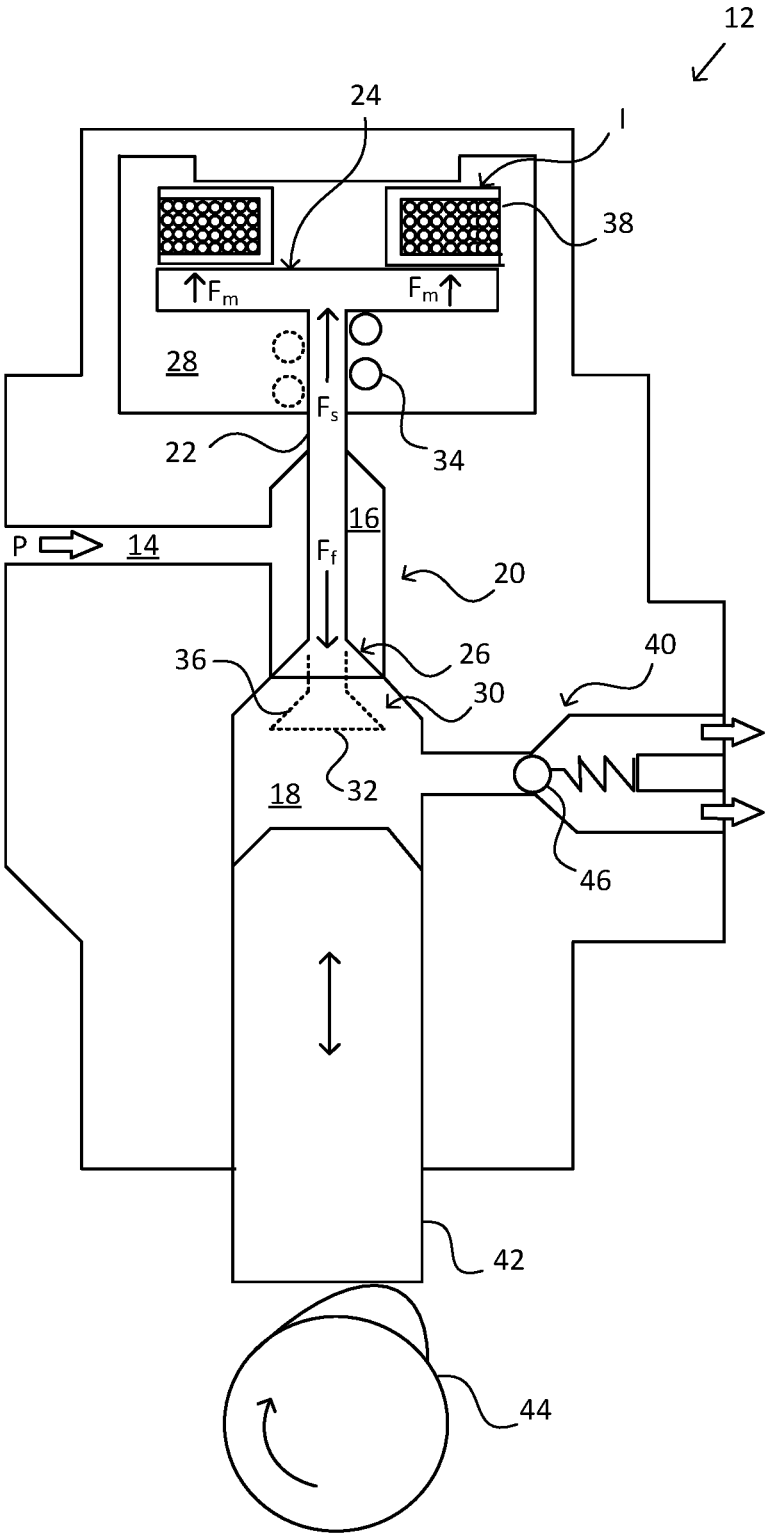
FIG. 3 shows a schematic cross sectional view of a high pressure fuel pump according to one aspect of the present invention.

FIG. 3 shows a schematic cross sectional view of a high pressure fuel pump 12 according to one aspect of the present invention. The high pressure fuel pump 12 is adapted as described in FIG. 2, with the difference that the electromagnetic unit 38 is arranged in such a manner that the magnetic force $F_m$ acts on the first end section 24 of the piston 22 in the same direction as the spring force $F_s$, and thus moves the piston 22 to a closed state. The spring force $F_s$, the feeding pressure P, with which fuel is fed, and the flow force $F_f$ are determined based on the pump's performance and dimensions. In order to achieve an open state of the inlet valve 20, the supply of current I through the electromagnetic unit 38 is controlled in such a manner that the magnetic force $F_m$ becomes zero. When the flow force $F_f$ is greater than the spring force $F_s$, an open state is therefore created in the inlet valve 20. In order to achieve a closed state of the inlet valve 20, the supply of electric current I through the electromagnetic unit 38 is controlled in such a manner that the sum of the magnetic force $F_m$ and the spring force $F_s$ exceeds the flow force $F_f$, and the piston 22 thus moves to the closed state. Should the electromagnetic unit 38 fail to function, the magnetic force $F_m$ becomes zero, and thus the open state of the inlet valve 20 is not impacted. This ensures that the combustion engine 2 is supplied with fuel, even in cases where the active control of the inlet valve 20 does not function.

Figure 4:
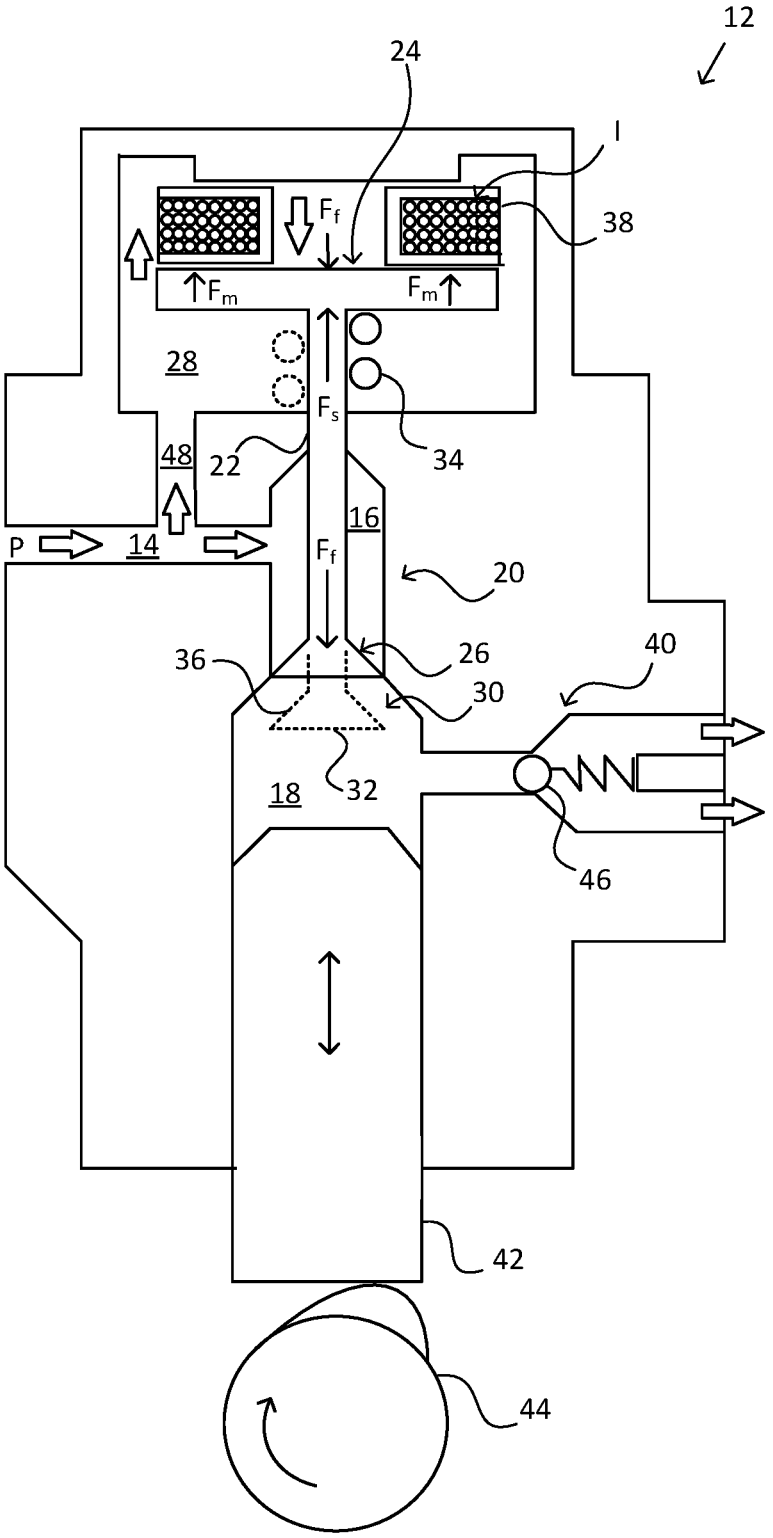
FIG. 4 shows a schematic cross sectional view of a high pressure fuel pump according to one aspect of the present invention, and FIG. 5 schematically shows a fuel system.

FIG. 4 shows a schematic cross sectional view of a high pressure fuel pump 12 according to one aspect of the present invention. The high pressure fuel pump 12 is adapted as described in FIG. 3, with the addition that a passage 48 is arranged between the inlet channel 14 and the third chamber 28. Thus, fuel may flow from the inlet channel 14 to the third chamber 28 and act on the first end section 24. In this manner, the area of the piston 22 on which the fuel acts becomes larger than when the passage 48 to the third chamber 28 is missing. Since the fuel acts on a larger area, the total flow force $F_f$ acting on the piston 22 increases, so that an open state of the inlet valve 20 is achieved in a simpler manner.

Figure 5:
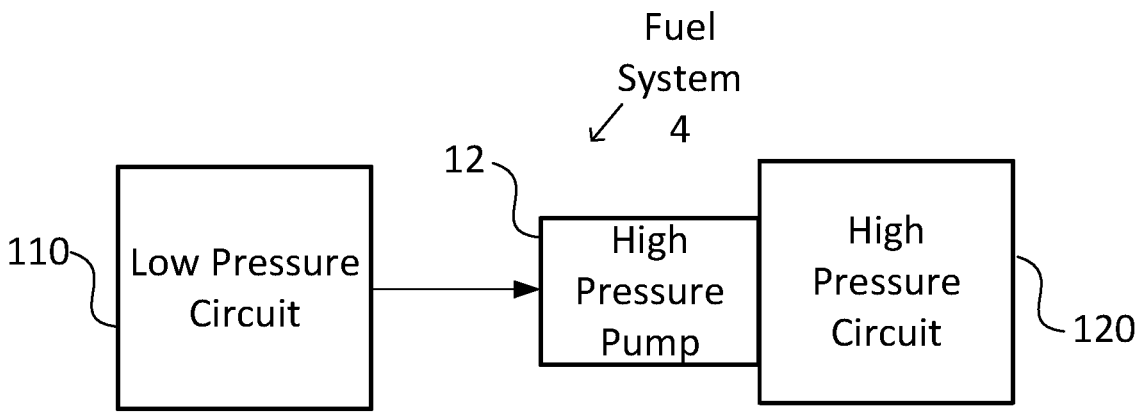

FIG. 5 illustrates schematically a fuel system 4, comprising a low pressure circuit 110 from which fuel is supplied to a high pressure pump 12 according to the above. The high pressure pump is a part of the fuel system's 4 high pressure circuit 120, from which fuel is supplied to the combustion engine 2 with a high pressure.

Figure 6:
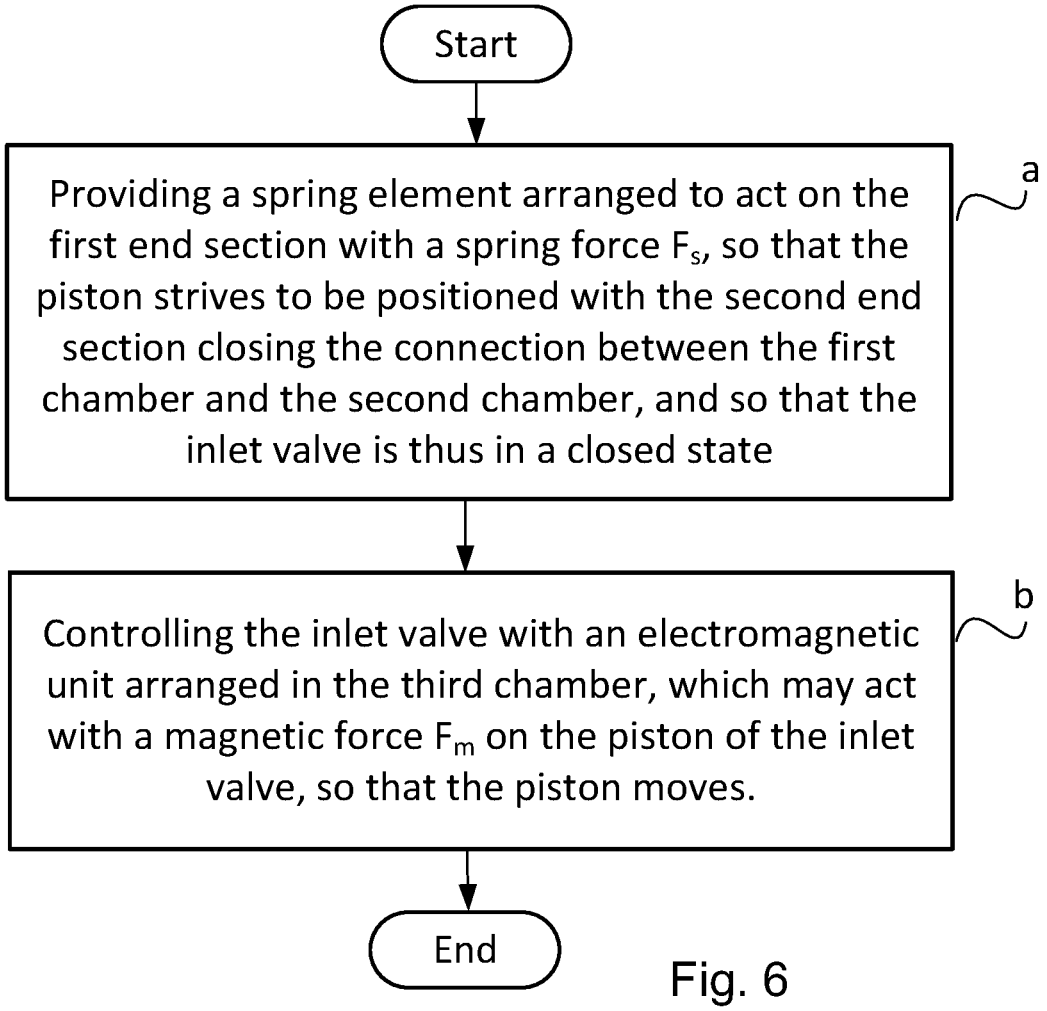
FIG. 6 shows a flow chart of a method for a high pressure fuel pump according to the present invention.

FIG. 6 shows a flow chart over a method for a high pressure fuel pump 12 in a fuel system 4 for a combustion engine 2, comprising an inlet channel 14 in connection with a first chamber 16, and through which fuel from a low pressure circuit in the fuel system 4 is led to the first chamber 16, a second chamber 18 arranged in connection with the first chamber 16, an outlet valve 40 arranged in connection with the second chamber 18, and an inlet valve 20 comprising a piston 22 with a first end section 24 and a second end section 26, wherein the piston 22 is moveably arranged with the first end section 24 in a third chamber 28, and the second end section 26 is movably arranged between the first chamber 16 and the second chamber 18. The method comprises the steps of a) providing a spring element 34 arranged to act on the first end section 24 with a spring force $F_s$, so that the piston 22 strives to be positioned with the second end section 26 closing the connection between the first chamber 16 and the second chamber 18, and so that the inlet valve 20 is thus in a closed state; and b) controlling the inlet valve 20 with an electromagnetic unit 38 arranged in the third chamber 28, which may act with a magnetic force $F_m$ on the piston 22 of the inlet valve 20, so that the piston 22 moves.

Preferably, the feeding pressure P, with which fuel is supplied to the first chamber 16, entails a flow force $F_f$, which acts on the piston 22 in a direction opposed to the spring force $F_s$.

The inlet valve 20 is suitably controlled by controlling the supply of electric current I through the electromagnetic unit 38.

According to one aspect of the present invention, the electromagnetic unit 38 is arranged in such a manner that the magnetic force $F_m$ acts on the piston 22 in a direction opposed to the spring force $F_s$. By controlling the supply of electric current I through the electromagnetic unit 38, so that a magnetic force $F_m$ is obtained, an open state of the inlet valve 20 may be achieved. A closed state of the inlet valve 20 may be achieved by stopping the supply of electric current I through the electromagnetic unit 38, so that the magnetic force $F_m$ becomes negligible and does not act on the piston 22. The spring force $F_s$ is then greater than the flow force $F_f$, so that the piston 22 is moved to the closed state.

According to one aspect of the present invention, the electromagnetic unit 38 is arranged in such a manner that the magnetic force $F_m$ acts on the piston 22 in the same direction as the spring force $F_s$. By controlling the supply of electric current I through the electromagnetic unit 38 so that a magnetic force $F_m$ is obtained, a closed state of the inlet valve 20 may be achieved. An open state of the inlet valve 20 may be achieved by stopping the supply of electric current I through the electromagnetic unit 38, so that the magnetic force $F_m$ becomes negligible and does not act on the piston 22. The spring element 34 is adapted, so that the flow force $F_f$ is greater than the spring force $F_s$, and so that the piston 22 is moved to an open state thanks to the flow force $F_f$.

Preferably, an open state of the inlet valve 20 is achieved, in the event that the electromagnetic unit 38 is out of order, by way of ensuring that the flow force $F_f$ is greater than the spring force $F_s$. In the event that the electromagnetic unit 38 is arranged to act with the magnetic force $F_m$ in a direction opposed to the spring force $F_s$, it is ensured that the flow force $F_f$ is greater than the spring force $F_s$, suitably by way of increasing the feeding pressure P, with which fuel is being fed. In the event that the electromagnetic unit 38 is arranged to act with the magnetic force $F_m$ in the same direction as the spring force $F_s$, it is ensured that the flow force $F_f$ is greater than the spring force $F_s$, by way of providing a spring element 34 with a spring force $F_s$, which is lower than the flow force $F_f$.

The components and features specified above may, within the framework of the invention, be combined between different embodiments specified.

The invention claimed is:

1. A fuel system comprising a high pressure fuel pump and a low pressure circuit, from which fuel is arranged to be supplied to the high pressure fuel pump, wherein the high pressure fuel pump comprises:

an inlet channel in connection with a first chamber, and through which fuel is led to the first chamber with a feeding pressure;

a second chamber arranged in connection with the first chamber;

an outlet valve arranged in connection with the second chamber; and an inlet valve comprising a piston, with a first end section and a second end section, wherein the piston is moveably arranged with the first end section in a third chamber, and the second end section is moveably arranged between the first chamber and the second chamber, wherein a press element is arranged to act on the piston with a mechanic force, so that the piston strives to be positioned with the second end section closing the connection between the first chamber and the second chamber, and so that the inlet valve is thus in a closed state, wherein the inlet valve is controllable using a controllable electromagnetic unit arranged in the third chamber, in order to act with a magnetic force on the piston, so that the piston moves, wherein the fuel system is arranged in such a manner that the feeding pressure entails a flow force acting on the piston in a direction opposed to the mechanic force, wherein the electromagnetic unit is arranged to:

act with the magnetic force on the piston in a direction opposed to the mechanic force, in order to achieve an open state of the inlet valve, wherein the low pressure circuit comprises a low pressure pump configured to increase the feeding pressure of the fuel from the low pressure circuit in cases where the electromagnetic unit is out of order, so that the flow force becomes greater than the mechanic force; or act with the magnetic force on the piston in the same direction as the mechanic force, in order to achieve a closed state of the inlet valve, wherein the mechanic force is smaller than the flow force caused by the feeding pressure at normal operation.

2. A fuel system according to claim 1, wherein the press element is arranged to act on the first end section of the piston.

3. A fuel system according to claim 1, wherein the magnetic force is arranged to act on the first end section of the piston.

4. A fuel system according to claim 1, wherein the magnetic force is achieved by way of an electric current being led through the electromagnetic unit.

5. A fuel system according to claim 1, wherein, if the electromagnetic unit is arranged to act with the magnetic force on the piston in the same direction as the spring force in order to achieve a closed state of the inlet valve, a passage is arranged between the inlet channel and the third chamber, so that fuel which is fed through the inlet channel may flow to the third chamber.

6. A fuel system according to claim 1, wherein the outlet valve is a check valve.

7. A fuel system according to claim 1, wherein a pressure element is moveably arranged in the second chamber, in connection with a camshaft in a combustion engine.

8. A fuel system according to claim 7, wherein the pressure element is arranged to increase the pressure of the fuel in the second chamber, and thus to facilitate feeding of the fuel through the outlet valve.

9. A fuel system according to claim 1, wherein the press element is a spring element and the mechanic force is a spring force.

10. A combustion engine comprising a fuel system, wherein the fuel system comprises a high pressure fuel pump and a low pressure circuit, from which fuel is arranged to be supplied to the high pressure fuel pump, wherein the high pressure fuel pump comprises:

an inlet channel in connection with a first chamber, and through which fuel is led to the first chamber with a feeding pressure;

a second chamber arranged in connection with the first chamber;

an outlet valve arranged in connection with the second chamber; and an inlet valve comprising a piston, with a first end section and a second end section, wherein the piston is moveably arranged with the first end section in a third chamber, and the second end section is moveably arranged between the first chamber and the second chamber, wherein a press element is arranged to act on the piston with a mechanic force, so that the piston strives to be positioned with the second end section closing the connection between the first chamber and the second chamber, and so that the inlet valve is thus in a closed state, wherein the inlet valve is controllable using a controllable electromagnetic unit arranged in the third chamber, in order to act with a magnetic force on the piston, so that the piston moves, wherein the fuel system is arranged in such a manner that the feeding pressure entails a flow force acting on the piston in a direction opposed to the mechanic force, wherein the electromagnetic unit is arranged to:

act with the magnetic force on the piston in a direction opposed to the mechanic force, in order to achieve an open state of the inlet valve, wherein the low pressure circuit comprises a low pressure pump configured to increase the feeding pressure of the fuel from the low pressure circuit in cases where the electromagnetic unit is out of order, so that the flow force becomes greater than the mechanic force; or act with the magnetic force on the piston in the same direction as the mechanic force, in order to achieve a closed state of the inlet valve, wherein the mechanic force is smaller than the flow force caused by the feeding pressure at normal operation.

11. A vehicle comprising a fuel system, wherein the fuel system comprises a high pressure fuel pump and a low pressure circuit, from which fuel is arranged to be supplied to the high pressure fuel pump, wherein the high pressure fuel pump comprises:

an inlet channel in connection with a first chamber, and through which fuel is led to the first chamber with a feeding pressure;

a second chamber arranged in connection with the first chamber;

an outlet valve arranged in connection with the second chamber; and an inlet valve comprising a piston, with a first end section and a second end section, wherein the piston is moveably arranged with the first end section in a third chamber, and the second end section is moveably arranged between the first chamber and the second chamber, wherein a press element is arranged to act on the piston with a mechanic force, so that the piston strives to be positioned with the second end section closing the connection between the first chamber and the second chamber, and so that the inlet valve is thus in a closed state, wherein the inlet valve is controllable using a controllable electromagnetic unit arranged in the third chamber, in order to act with a magnetic force on the piston, so that the piston moves, wherein the fuel system is arranged in such a manner that the feeding pressure entails a flow force acting on the piston in a direction opposed to the mechanic force, wherein the electromagnetic unit is arranged to:

act with the magnetic force on the piston in a direction opposed to the mechanic force, in order to achieve an open state of the inlet valve, wherein the low pressure circuit comprises a low pressure pump configured to increase the feeding pressure of the fuel from the low pressure circuit in cases where the electromagnetic unit is out of order, so that the flow force becomes greater than the mechanic force; or act with the magnetic force on the piston in the same direction as the mechanic force, in order to achieve a closed state of the inlet valve, wherein the mechanic force is smaller than the flow force caused by the feeding pressure at normal operation.

12. A fuel system according to claim 1, wherein the low pressure pump is operated by an electric motor.

* * * * *